US012582874B2

(12) United States Patent
Lee

(10) Patent No.: US 12,582,874 B2
(45) Date of Patent: Mar. 24, 2026

(54) APPARATUS FOR ARTIFICIAL INTELLIGENCE EXERCISE RECOMMENDATION BY ANALYZING DATA COLLECTED BY POSTURE MEASUREMENT SENSOR AND DRIVING METHOD THEREOF

(71) Applicant: PostureAI Inc., Incheon (KR)

(72) Inventor: Eun Young Lee, Seongnam-si Gyeonggi-do (KR)

(73) Assignee: PostureAI Inc., Incheon (KR)

( * ) Notice: Subject to any disclaimer, the term of this patent is extended or adjusted under 35 U.S.C. 154(b) by 358 days.

(21) Appl. No.: 18/536,386

(22) Filed: Dec. 12, 2023

(65) Prior Publication Data

US 2024/0165464 A1 May 23, 2024

(30) Foreign Application Priority Data

Nov. 1, 2022 (KR) ..... 10-2022-0144010

(51) Int. Cl.
*A63B 24/00* (2006.01)
*A63B 71/06* (2006.01)

(52) U.S. Cl.
CPC ..... *A63B 24/0075* (2013.01); *A63B 24/0062* (2013.01); *A63B 71/0622* (2013.01); *A63B 2071/063* (2013.01)

(58) Field of Classification Search
CPC ..... A63B 24/0087; A63B 24/0075; A63B 24/0062; A63B 71/0622
See application file for complete search history.

(56) References Cited

U.S. PATENT DOCUMENTS 11,544,865 B1 * 1/2023 Kurz ..... G06T 7/73
11,967,217 B1 * 4/2024 Andrews ..... G08B 29/186
(Continued)

FOREIGN PATENT DOCUMENTS

KR 101480026 B1 1/2015
KR 102310852 B1 10/2021
(Continued)

OTHER PUBLICATIONS

1st Office Action on Korean Patent Application No. KR 10-2022-0144010 issued Jan. 25, 2023.
(Continued)

*Primary Examiner* — Steve Rowland
(74) *Attorney, Agent, or Firm* — Dinsmore & Shohl LLP; Yongsok Choi, Esq.

(57) ABSTRACT

The present invention relates to an apparatus for recommending artificial intelligence (AI) exercise by analyzing data collected by a posture measurement sensor and driving method thereof. The apparatus for recommending AI exercise by analyzing data collected by a posture measurement sensor according to an embodiment of the present invention may include a communication interface unit that receives sensing data according to measurement of a user's posture from a posture measuring apparatus including a posture measurement sensor for measuring the user's posture, and a control unit that collects the received sensing data to form big data, analyzes the big data using an AI program to determine postures of each user according to a change in time, and recommends exercise for posture correction to user terminal apparatuses of each user based on a determination result.

10 Claims, 3 Drawing Sheets

(56) References Cited

U.S. PATENT DOCUMENTS

| | | | | |
|---|---|---|---|---|
| 2006/0207117 | A1* | 9/2006 | Sobol | G01C 15/00 33/286 |
| 2009/0054814 | A1* | 2/2009 | Schnapp | A61B 5/1116 600/595 |
| 2014/0303535 | A1* | 10/2014 | Yip | A61F 5/026 602/19 |
| 2015/0065919 | A1* | 3/2015 | Cuevas | A61B 5/746 600/587 |
| 2016/0029929 | A1* | 2/2016 | Worthen | A61B 5/1116 600/595 |
| 2017/0354843 | A1* | 12/2017 | Vuillerme | A61B 5/6898 |
| 2018/0174320 | A1* | 6/2018 | Hayashi | G08B 25/04 |
| 2019/0008447 | A1* | 1/2019 | Lacker | A61B 5/0002 |
| 2019/0117124 | A1* | 4/2019 | Hsu | A61B 5/6892 |
| 2020/0297248 | A1* | 9/2020 | Shin, Jr. | A61B 5/6823 |
| 2020/0352476 | A1* | 11/2020 | Ladd | G06F 3/14 |
| 2021/0100480 | A1* | 4/2021 | Kang | G06N 3/08 |
| 2022/0387000 | A1* | 12/2022 | Yoo | A61B 8/4254 |

FOREIGN PATENT DOCUMENTS

| | | | |
|---|---|---|---|
| KR | 1020220085445 | A | 6/2022 |
| KR | 1020220109569 | A | 8/2022 |

OTHER PUBLICATIONS

Final Rejection on Korean Patent Application No. KR 10-2022-0144010 issued May 30, 2023.

* cited by examiner (a) SENSOR (b) BRA (c) SEAT (d) PODS

APPARATUS FOR ARTIFICIAL INTELLIGENCE EXERCISE RECOMMENDATION BY ANALYZING DATA COLLECTED BY POSTURE MEASUREMENT SENSOR AND DRIVING METHOD THEREOF

CROSS-REFERENCE TO RELATED APPLICATIONS

This application claims priority to Korean Patent Application No. 10-2022-0144010 filed on Nov. 1, 2022, the entire contents of which are herein incorporated by reference.

BACKGROUND

1. Field of the Invention

The present invention relates to an apparatus for recommending artificial intelligence (AI) exercise by analyzing data collected by a posture measurement sensor and a method of driving thereof, and more particularly, to an apparatus for recommending AI exercise by analyzing data collected by a posture measurement sensor, which is capable of recommending exercises to users based on spine tilt detection, posture determination, and real-time posture analysis using, for example, a pivot mechanism, and a driving method thereof.

2. Discussion of Related Art

Among the common diseases of modern people, diseases related to a musculoskeletal system are often caused by bad posture or lifestyle habits of maintaining the same posture over a long period of time due to the increase in sedentary lifestyles, computer-based work environments, and increasing usage time of portable devices such as smartphones and tablets, and the incidence of the diseases is increasing. In particular, modern people who have sedentary lifestyles often repeat a posture of lowering their head or bending their back forward. When this posture continues, a head will gradually move forward from a center of a body, shoulders will slump, and a back will bend. In addition, due to a weight of the head, muscles connected to neck muscles become stiff due to tension in the neck muscles, and shoulder muscles are also constantly tense to support the weight of the head, which easily leads to fatigue. In addition, when the back is bent, joints of a spine turn backwards from the center of the body, so the center of the body tends to be shifted or tilted to the left or right.

Therefore, since it is very important for modern people to maintain their correct postures, chairs, desks, and the like are being made ergonomically in view of the sedentary lifestyles. Recently, technologies for posture correction are emerging.

However, so far, users have not received appropriate feedback for the posture correction, or the posture correction customized to each user has not been performed properly.

RELATED ART DOCUMENT

Patent Document (Patent Document 1) Korean Patent No. 10-1480026 (Dec. 31, 2014)

(Patent Document 2) Korean Patent No. 10-2310852 (Oct. 1, 2021)

(Patent Document 3) Korean Patent No. 10-2022-0085445 (Jun. 22, 2022)

SUMMARY OF THE INVENTION

The present invention is to recommend exercises to users based on spine tilt detection, posture determination, and real-time posture analysis using, for example, a pivot mechanism.

Problems of the present invention are not limited to the above-described problems. That is, other problems that are not described may be obviously understood by those skilled in the art from the following specification.

According to an embodiment of the present invention, an apparatus for recommending artificial intelligence (AI) exercise by analyzing data collected by a posture measurement sensor may include a communication interface unit that receives sensing data according to measurement of a user's posture from a posture measuring apparatus including a posture measurement sensor for measuring the user's posture, and a control unit that collects the received sensing data to form big data, analyzes the big data using an AI program to determine postures of each user according to a change in time, and recommends exercises for posture correction to user terminal apparatuses of each user based on a determination result.

The control unit may analyze the sensing data provided by measuring the user's posture in the forward and backward, left and right, and 360° directions by the posture measuring apparatus worn on a central portion of the user's chest, and recommend the exercises based on the analysis result.

When requesting service from the user terminal apparatus, the control unit may provide a visualization screen related to a tilt of the user's body in the 360° direction.

The control unit may compare and analyze reference posture data preset based on a human spine with the sensing data for each user, detect spine tilts for each user, and determine postures of each user based on the detection result.

The control unit may receive and process sensing data on spine movement forward and backward, left and right, and 360° for each user generated by a posture sensor as the posture measurement sensor.

According to another embodiment of the present invention, a method of driving an apparatus for recommending artificial intelligence (AI) exercise by analyzing data collected by a posture measurement sensor may include receiving, by a communication interface unit, sensing data according to measurement of a user's posture from a posture measuring apparatus including a posture measurement sensor for measuring the user's posture, and collecting, by a control unit, the received sensing data to form big data, analyzing the big data using an AI program to determine each user's posture according to a change in time, and recommending exercises for posture correction to user terminal apparatuses of each user based on the determination result.

In the recommending of the exercise for posture correction, the sensing data provided by measuring the user's posture in the forward and backward, left and right, and 360° directions by the posture measuring apparatus worn on a central portion of the user's chest may be analyzed, and the exercises may be recommended based on the analysis result.

In the recommending of the exercise for posture correction, when requesting service from the user terminal apparatus, a visualization screen related to a tilt of the user's body in the 360° direction may be provided.

In the recommending of the exercise for posture correction, reference posture data preset based on a human spine may be compared and analyzed with the sensing data for each user, spine tilts for each user may be detected, the postures of each user may be determined based on a detection result.

In the recommending of the exercise for posture correction, sensing data on spine movement forward and backward, left and right, and 360° for each user generated by a posture sensor as the posture measurement sensor may be received and processed.

Detailed matters of other embodiments are described in a detailed description and are illustrated in the accompanying drawings.

DETAILED DESCRIPTION OF EXEMPLARY EMBODIMENTS

Figure 1:
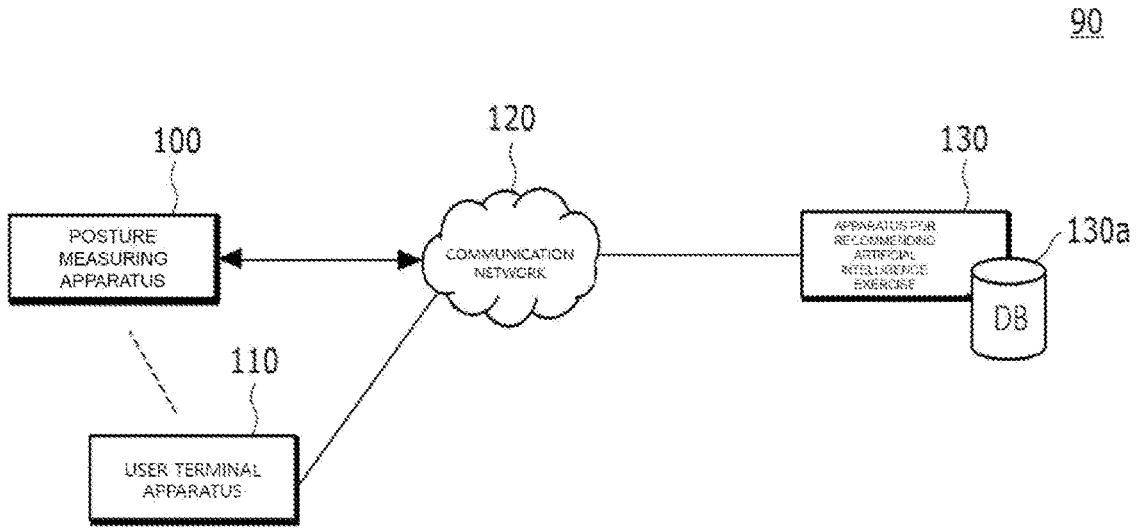
FIG. 1 is a diagram illustrating a system for recommending artificial intelligence (AI) exercise by analyzing data collected by a posture measurement sensor according to an embodiment of the present invention.

Hereinafter, various exemplary embodiments of the present disclosure will be described in detail with reference to the accompanying drawings. Various advantages and features of the present invention and methods accomplishing them will become apparent from the following description of embodiments with reference to the accompanying drawings. However, the present invention is not limited to exemplary embodiments to be described below, but may be implemented in various different forms, these embodiments will be provided only in order to make the present invention complete and allow those skilled in the art to completely recognize the scope of the present invention, and the present invention will be defined by the scope of the claims.

The shapes, sizes, proportions, angles, numbers, etc., disclosed in the drawings for describing embodiments of the present invention are illustrative, and the present invention is not limited to the matters illustrated. Throughout the specification, like reference numerals denote like elements. Further, when it is determined that a detailed description of the known art related to the present disclosure may obscure the gist of the present disclosure, the detailed description thereof will be omitted. When "includes," "having," "formed of," etc., described in this specification are used, other parts may be added unless "only" is used. When a component is expressed in the singular, it may include a case in which the plural is included unless otherwise explicitly stated.

When interpreting components, it is interpreted to include an error range even if there is no separate explicit statement.

In the case of a description of a positional relationship, for example, when the positional relationship between two parts is described as "~on," "~over," '~below," '~next to," etc., unless "immediately" or "directly" is used, one or more other parts may be located between two parts.

When an element or layer is referred to as "on" another element or layer, it includes instances where other layers or other elements are directly on other elements or interposed between the other elements.

Although "first," "second," and the like are used to describe various components, it goes without saying that these components are not limited by these terms. These terms are used only to distinguish one component from other components. Therefore, it goes without saying that the first component mentioned below may be the second component within the technical scope of the present invention.

Throughout the specification, like reference numerals denote like elements.

Sizes and thicknesses of each component shown in the drawings are illustrated for convenience of description, and the present invention is not necessarily limited to the sizes and thicknesses of the components illustrated.

Each feature of various embodiments of the present invention may be partially or fully coupled or combined with each other, and as can be fully understood by those skilled in the art, various technical linkages and operations are possible, and each embodiment can be implemented independently of each other and can be performed together due to the related relationship.

FIG. 1 is a diagram illustrating a system for recommending artificial intelligence (AI) exercise by analyzing data collected by a posture measurement sensor according to an embodiment of the present invention, and FIGS. 2A, 2B, 2C, and 2D are diagrams illustrating various types of posture measuring apparatus of FIG. 1.

As illustrated in FIG. 1, a system 90 for recommending AI exercise by analyzing data collected by a posture measurement sensor (hereinafter referred to as a system for recommending AI exercise) according to the embodiment of the present invention includes some or all of a posture measuring apparatus 100, a user terminal apparatus 110, a communication network 120, and an apparatus 130 for recommending AI exercise.

Here, "including part or all" means that the system 90 for recommending AI exercise is configured by omitting some components such as the user terminal apparatus 110, or some or all of the components constituting the apparatus 130 for recommending AI exercise may be integrated and configured into a network device (e.g., wireless exchange device, etc.) constituting the communication network 120, and the present invention is described as including all the components in order to facilitate a sufficient understanding of the present invention.

The posture measuring apparatus 100 may measure a posture of every user when the users sit, stand, or move. In order to measure users' posture, the posture measuring apparatus 100 may include various types of sensors. Of course, a type of sensor mounted on the posture measuring apparatus 100 may be different depending on what type of apparatus the posture measuring apparatus 100 is. For example, as illustrated FIG. 2A, in the case of wearable devices that users wear like a belt around a central portion of a chest, a 3-axis acceleration sensor, 3-axis gyro sensor, or the like that may measure movement of a user's body in forward and backward, left and right, and 360° directions may be preferable. In other words, angles in the forward and backward or left and right may be measured through the 3-axis gyro sensor along with direction information. More precisely, the 3-axis acceleration sensor or the 3-axis gyro sensor may be used. The sensor corresponds to an inertial measurement unit (IMU) and can measure posture angles, posture angular velocities, accelerations, etc., of users.

Figure 2A:
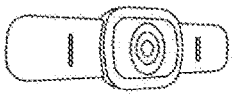
FIGS. 2A, 2B, 2C, and 2D are diagrams illustrating various types of posture measuring apparatus of FIG. 1.
Figure 2B:
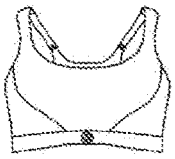

In addition, as illustrated FIG. 2B, since the posture measuring apparatus 100 covers an upper part of a body, such as a spine part, due to the nature of clothing in the case of a sports bra, a sensor is mounted on or configured inside of the sports bra corresponding to the spine part, so it may be possible to generate sensing data to measure spine tilts of users. Of course, after wearing the sports bra, sensing data on a spine may be collected when a user bends over and stands upright. For example, based on the analysis results of the sensing data when the user stands, the sensing data may be compared with reference data to determine the spine tilt, that is, bending of a back.

Figure 2C:
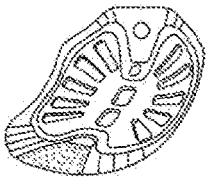
Figure 2D:
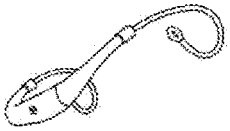

In addition, a smart seat as illustrated in FIG. 2C may be equipped with a pressure sensor. Of course, in this case, the pressure sensor may include or generate direction information to determine where the pressure sensor is located on a smart seat. In an embodiment of the present invention, the smart seat may include a gyro sensor capable of measuring direction information, and therefore, will not be particularly limited to any one form. The smart seat may receive sensing data from the pressure sensor on the premise that it may know direction information and determine which side is most pressured to analyze a user's sitting posture. Furthermore, FIG. 2D illustrates a turtleneck habit corrector. A neck's posture may be measured based on the sensing data measured through the turtle neck habit corrector, and correction actions may also be performed using the turtleneck habit corrector. For example, the turtleneck habit corrector worn on a user's head or neck may provide sensing data generated by detecting or measuring neck movement through a 3-axis acceleration sensor, a 3-axis gyro sensor, etc., provided therein.

As described above, the posture measuring apparatus 100 according to the embodiment of the present invention may use various types of apparatuses alone or in combination. For example, at least one of the wearing apparatus, sports bra, smart seat, and turtleneck habit corrector illustrated in FIGS. 2A through 2D is owned by a user and may be used to measure posture. For example, it may be possible for users to purchase and use only two or three of the apparatuses. For example, users such as office workers who are concerned about their sitting postures and a turtleneck may purchase only a smart seat and a turtleneck habit corrector and use the smart seat and turtleneck habit corrector to correct their postures. Of course, office workers and users working in other occupations may only use the wearable device worn in a center of a chest of a body and smart seat due to concerns about a sitting posture and a spinal curve. For example, users who practice yoga or athletes may use the sports bra to correct their exercises or training postures.

The user terminal apparatus 110 may include not only mobile-based apparatuses such as smartphones and wearable devices worn on wrists of users, and tablet PCs, but also PC-based user devices such as desktop computers and laptop computers. The user terminal apparatus 110 may check various pieces of information related to a user's posture measured through the posture measuring apparatus 100. For example, when users have bad posture, the users may receive a notification that their current postures are not good. Of course, it is possible to provide such notification through the posture measuring apparatus 100 when the posture measuring apparatus 100 is equipped with a vibration motor, etc., but in the embodiment of the present invention, the notification will be described as being received through the user terminal apparatus 110 such as a smartphone. In addition, the user terminal apparatus 110 may check a graphic screen for analysis results of users' sensing data collected through the posture measuring apparatus 100, that is, the posture measurement data.

For example, in the case of the smartphone, the user terminal apparatus 110 may access the apparatus 130 for recommending AI exercise of FIG. 1 by running a dedicated application (hereinafter referred to as an app) for using service according to an embodiment of the present invention, and thus, check various posture-related data. Typically, the user terminal apparatus 110 may check analysis results of data by cycle, such as daily, weekly, and monthly, as well as analysis results of time to maintain correct posture. In addition, the user terminal apparatus 110 may check a user's daily posture as a score and furthermore check analysis results of a 360° posture zone. A tilted direction of a user's body is visualized and displayed in a 360° posture zone. For example, the visualization screen may be displayed as a graphic screen in the form of a chart.

Furthermore, the user terminal apparatus 110 may receive recommendation for exercises for posture correction in relation to one's own posture from the apparatus 130 for recommending AI exercise of FIG. 1, and can also receive a posture correction subscription service or receive AI-based 1:1 customized posture coaching. Here, the user terminal apparatus 110 may perform the AI-based 1:1 customized posture coaching through chat using, for example, a messenger-based posture AI chatbot. In addition, in the case of a regular subscription service, the user terminal apparatus 110 may regularly receive content related to good exercises for correcting certain posture, and receive a variety of content through the subscription service. In this process, the user terminal apparatus 110 may be recommended exercise equipment that is suitable for specific posture correction exercise. Of course, such exercise equipment recommendations may be made in the form of advertisements, and therefore, embodiments of the present invention will not be particularly limited to any one form.

The communication network 120 includes both wired and wireless communication networks. For example, the wired/wireless Internet network may be used or linked as the communication network 120. Here, the wired network includes an Internet network such as a cable network or a public telephone network (PSTN), and the wireless communication network includes code division multiple access (CDMA), wideband CDMA (WCDMA), global system for mobile communications (GSM), evolved packet core (EPC), Long Term Evolution (LTE), a WiBro network, and the like. Of course, the communication network 120 according to the embodiment of the present invention is not limited thereto, and may be used for, for example, a cloud computing network under a cloud computing environment, a 5G network, and the like as an access network of a next-generation mobile communication system to be implemented in the future. For example, when the communication network 120 is a wired communication network, an access point in the communication network 120 may connect to a switching center of a telephone office, etc., but in the case of a wireless communication network, may access SGSN or a gateway general packet radio service (GPRS) support node (GGSN) operating by a common carrier to process data or access various relay devices such as a base transceiver station (BTS), NodeB, and e-NodeB to process data.

The communication network 120 may include an access point. The access point includes a small base station, such as a femto or pico base station, which is mostly installed in a building. Here, a femto or pico base station is classified depending on how many posture measuring apparatus 100, user terminal apparatus 110, etc., may be connected regarding the classification of small base stations. Of course, the access point may include the posture measuring apparatus 100, the user terminal apparatus 110, and a short-range communication module for performing short-range communication such as ZigBee and wireless fidelity (Wi-Fi). The access point may use a transmission control protocol/Internet protocol (TCP/IP) or a real-time streaming protocol (RTSP) for wireless communication. Here, the short-distance communication may be performed in various standards such as radio frequency (RF) such as Bluetooth, Zigbee, infrared (IrDA), ultra high frequency (UHF), and very high frequency (VHF) and ultra-wideband communication (UWB), in addition to Wi-Fi. Accordingly, the access point may extract a location of a data packet, designate the best communication path for the extracted location, and transmit the data packet to the next device, for example, the apparatus 130 for recommending AI exercise along the designated communication path. The access point may share several lines in a general network environment, and includes, for example, a router, a repeater, a relay device, and the like.

The apparatus 130 for recommending AI exercise collects sensing data from the posture measuring apparatus 100 used by users in an onboarding manner to form big data, and analyzes the formed big data to determine a posture of every user according to a change in time. Here, the onboarding may mean methods such as wearing or sitting. Accordingly, the posture measuring apparatus 100 may start an operation to generate sensing data through the onboarding. The above "posture according to change in time" may determine how the user's posture changes over time to predict a future posture based on the degree of change. Therefore, the apparatus 130 for recommending AI exercise may provide related videos, etc., while recommending exercises for posture correction to the user terminal apparatus 110 of the user based on the prediction results. Of course, it is also possible to provide URL information to access the video. In order to recommend exercises, it is desirable to utilize 3D data provided from the posture measuring apparatus 100 of FIG. 1. The apparatus 130 for recommending AI exercise can recommend appropriate exercises only by using sensing data on the movement of the user's body in the forward and backward, left and right, and 360° directions, that is, the user's posture.

In addition, the apparatus 130 for recommending AI exercise according to an embodiment of the present invention may further provide various additional services in addition to recommending exercises for posture correction using the user terminal apparatus 110 of the user based on the analysis results of the sensing data provided by the posture measuring apparatus 100. For example, the apparatus 130 for recommending AI exercise may display a calendar in a first zone at a top of the screen to provide a UI screen related to a posture score, a daily goal, and a 360° posture zone to the user terminal apparatus 110, and display the daily goal in the form of diagrams such as a chart, a graph, and a statistical chart on the left in a second zone located at a bottom of the first zone or display the posture score on the right in the second zone. Furthermore, the 360° posture zone chart of the user's posture may be displayed in a third zone located at the bottom of the second zone on the same UI screen. Of course, the chart may be displayed in various colors. For example, when a user's posture is tilted forward a lot, a front portion may be displayed in red, etc.

More specifically, the chart may be graphically processed in the form of a target, and an appearance of a user as seen from above may be displayed in a center of the chart. Therefore, the corresponding portion may be displayed in red by setting a front when the user is looking toward the front. The chart in the form of the target is divided into eight sections: front F, FR, right R, BR, rear B, BL, left L, and FL. The chart may generate a UI screen so that the user's current posture may be seen at a glance and provide the generated UI screen to the user terminal apparatus 110.

Meanwhile, the apparatus 130 for recommending AI exercise collects 360° sensing data provided by the posture measuring apparatus 100 to generate big data, analyzes the generated big data through an artificial intelligence program to analyze a direction in which a body of every user is tilted in a 360° direction, and recommends customized posture correction exercises for posture correction of each user to the user terminal apparatus 110 based on the analysis results. In this process, when recommending the customized posture correction exercise to each user, the apparatus 130 for recommending AI exercise may not recommend exercises only to the posture measuring apparatus 100 that each user possesses, but if data for exercise recommendation is, for example, data constructed based on a total of four posture measuring apparatuses 100, refer to data related to the remaining four posture measuring apparatuses 100 together to recommend the customized posture correction exercises to the corresponding user. Of course, in this case, the reference data uses data from users of the same sex or the same or similar age, or furthermore, uses analysis results of data from users belonging to the same or similar occupational group. In reality, this is because the body's posture may be related to a head, a neck, a spine, a lower back, etc. In this way, the apparatus 130 for recommending AI exercise may increase its accuracy when recommending the posture correction exercises.

For a more specific example, since the type of posture measuring apparatuses 100 possessed by each user may be different, the apparatus 130 for recommending AI exercise may recommend exercises based on data acquired from the posture measuring apparatus 100 possessed by each user. However, since the apparatus 130 for recommending AI exercise collects big data, for example, by reflecting data from the posture measuring apparatus 100 that users A and B do not possess, it is possible to further increase objectivity, that is, accuracy when recommending the posture correction exercises. In other words, it may be considered more accurate to recommend the posture correction exercises based on the analysis results of data acquired by 100 people rather than recommending the posture correction exercises based on the analysis results of data acquired by 5 people. Therefore, the apparatus 130 for recommending AI exercise is not limited to the sensing data of the posture measuring apparatus 100 possessed by the user, but may recommend exercises by comprehensively determining the posture measurement data of other users. For example, if the apparatus 130 for recommending AI exercise recommends posture correction exercises based on the analysis results of four posture measuring apparatus 100 as illustrated in FIG. 2, when the user may possess only a wearable device as illustrated (a) of FIG. 2, the apparatus 130 for recommending AI exercise reflects the remaining three data along with the sensing data of the corresponding wearable device, the apparatus 130 for recommending AI analyzes data commonly extracted from many users to recommend the posture correction exercises. Of course, in this process, the apparatus 130 for recommending AI exercise may retrieve and use data from users having the same or similar sex, age, physical condition, and occupation such as office workers.

In addition, the apparatus 130 for recommending AI exercise according to an embodiment of the present invention is also capable of providing posture correction services such as golf swing posture correction, fitness and virtual training, weightlifting posture correction, office worker posture correction, and musculoskeletal and physical therapy, and posture recognition or posture correction services in various fields such as preventing drowsiness of drivers and passengers, health status, behavior, and situation awareness, etc., through posture measurement, and therefore, embodiments of the present invention will not be specifically limited to posture correction operations in daily life.

Figure 3:
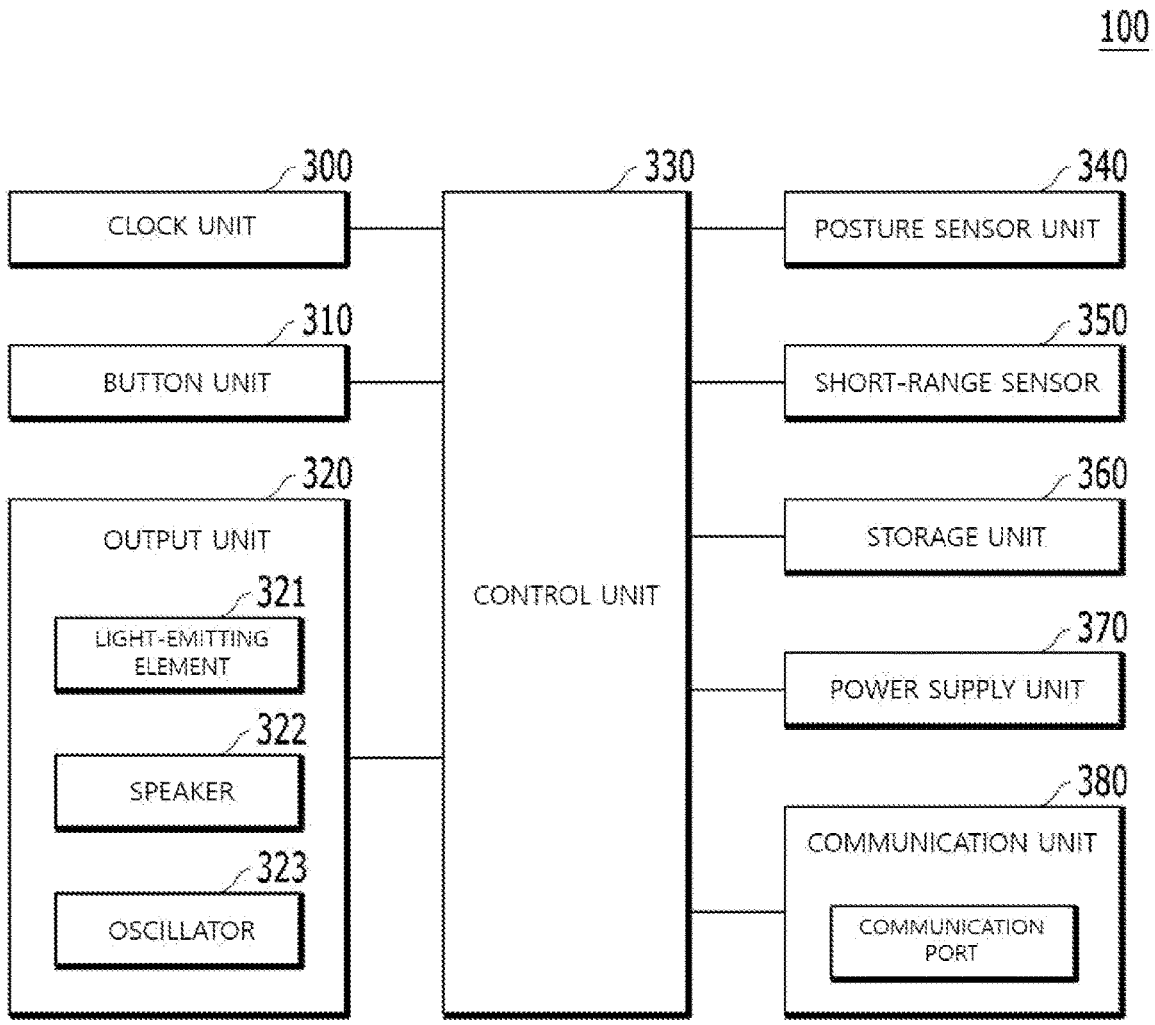
FIG. 3 is a block diagram illustrating a detailed structure of a posture measurement value of FIG. 1.

FIG. 3 is a block diagram illustrating the detailed structure of the posture measuring apparatus of FIG. 1.

As illustrated of FIG. 3, the posture measuring apparatus 100 of FIG. 1 may include some or all a clock unit (real-time clock (RTC)) 300, a button unit 310, an output unit 320, a control unit 330, a posture sensor unit 340, a short-range sensor unit 350, a storage unit 360, a power supply unit 370, and a communication unit 380.

Here, "including some or all" means that the posture measuring apparatus 100 is configured by omitting some components, such as the storage unit 360, some components, such as the clock unit 300, may be integrated with other components, such as the control unit 330, in the form of a software (S/W) module, or the like, and the present invention will be described as including all components to facilitate a sufficient understanding of the present invention.

The clock unit 300 corresponds to the RTC (unit). The RTC is a battery-powered clock, and may be included as part of a microchip within a mother board of a device such as a computer. This microchip is usually separate from the microprocessor and other chips and may be named 'CMOS'. System setting values are stored in a very small memory on the CMOS, including a current time stored by an RTC. The time value includes year, month, day of the week, hour, minute, and second. When a power supply of the computer, that is, the posture measuring apparatus 100, is turned on, a basic input/output system, that is, a BIOS, that is stored in the storage unit 360 such as ROM, may read the current time from the RTC and a memory in the chip. In an embodiment of the present invention, time information generated through the clock unit 300 may be provided along with sensing data to the apparatus 130 for recommending AI exercise of FIG. 1 for data analysis.

The button unit 310 may include various types of buttons, such as a power button unit for turning on a power supply. For example, when controlling a voice volume of a speaker 322 constituting the output unit 320 or vibration intensity of an oscillator 323, for example, a vibration motor, it may be possible to adjust the voice volume or the vibration intensity through volume buttons or various types of buttons that constitute the button unit 310. In addition, the button unit 310 may refer to a button on a touch screen. Through the button unit 310, operations such as setting a target, i.e., a device, for performing communication may be performed. For example, when only a TV, a computer, etc., is recognized in the surrounding area, the short-range communication with the device may be performed.

The output unit 320 includes a light-emitting element 321, a speaker 322, an oscillator 323, etc. When the light-emitting element 321 is powered on, the light-emitting element 321 may include an element such as an LED to display the current operating state of the posture measuring apparatus 100. In addition, the speaker 322 may output voice, and the oscillator 323 may generate vibrations. For example, when notifying a user using the posture measuring apparatus 100 that he or she has a bad posture, voice may be output to notify the corresponding contents through the speaker 322, or vibrations may be generated to correct a posture through the oscillator 323. In relation to this, it has been previously described that notification is made through the user terminal apparatus 110, but as it is possible to provide the notification through the posture measuring apparatus 100 as illustrated of FIG. 3, and therefore, the embodiments of the present invention will not be particularly limited to any one form.

The control unit 330 is responsible for the overall control operation of the clock unit 300, the button unit 310, the output unit 320, the posture sensor unit 340, the short-range sensor unit 350, the storage unit 360, the power supply unit 370, and the communication unit 380. Typically, when a user provides a power on command through the button unit 310, the control unit 330 may operate the posture measuring apparatus 100 to start an operation of measuring the user's posture. In this process, the control unit 330 may emit the light-emitting element 321 of the output unit 320 to display to the outside that the posture measuring apparatus 100 is in an operating state. In addition, when the user uses the posture measuring apparatus 100 in the onboarding manner, the control unit 330 may receive sensing data related to the user's posture measured through the posture sensor unit 340 or the like and temporarily store the received sensing data in the storage unit 360. The control unit 330 may combine the corresponding sensing data with time information provided by the clock unit 300 and further transmit the combined sensing data and time information to the apparatus 130 for recommending AI exercise of FIG. 1 through the communication unit 380, including its own device identification information.

The posture sensor unit 340 may include, for example, various types of sensors that may detect movement of a user's body in forward and backward, left and right, and 360° directions. As described above, the posture sensor unit 340 may include a 3-axis acceleration sensor, a 3-axis gyro sensor, etc., as an inertial measurement sensor to be able to measure a posture angle, posture angular velocity, acceleration, etc., related to the user's posture. The sensing data detected by the corresponding posture sensor may be provided to the apparatus 130 for recommending AI exercise of FIG. 1 along with the time information provided by the clock unit 300.

The short-range sensor unit 350 may include a proximity sensor, a short-range ultrasonic sensor, etc. For example, when the wearable device as illustrated in (a) of FIG. 2 is used, a direction may be detected through the gyro sensor, etc., but when a nearby computer is detected, the short-range sensor unit 350 may also be used to detect the corresponding computer and receive notifications such as "posture is bad when using the computer" In addition, when there is a TV nearby, the posture may be determined based on the TV. Of course, in the case of the computer, it may also be used to set the reference. It is determined that the direction in which the computer or TV is detected is a direction where the user is gazing. Furthermore, the short-range sensor unit 350 may operate to perform operations such as outputting voice contents related to the posture correction through the speaker when an artificial intelligence speaker, etc., is detected in a short distance. Of course, the detection of peripheral devices may be possible through beacon communication through the communication unit 380 of FIG. 3, and therefore, embodiments of the present invention will not be specifically limited to the short-range sensor.

The storage unit 360 may temporarily store various types of data processed by the control unit 330 and then output the stored data. For example, the control unit 330 may temporarily store the sensing data related to the users' postures generated through the posture sensor unit 340 in the storage unit 360. In addition, the time information provided by the clock unit 300 may be stored in the storage unit 360. The storage unit 360 may output the temporarily stored time information and sensing data in response to the request from the control unit 330. Of course, the device identification information of the currently used posture measuring apparatus 100 may be pre-stored in the storage unit 360, and the corresponding device identification information may also be provided together.

The power supply unit 370 may include a battery, etc. The power supply unit 370 provides a power supply voltage Vcc such as DC 3 to 5V to various components such as the output unit 320 and the posture sensor unit 340 under the control of the control unit 330. For example, the light-emitting element 321 may operate by a voltage of DC 3 to 5V, and the power supply unit 370 may provide a voltage of the corresponding magnitude. In addition, the sensor of the posture sensor unit 340 requires the power supply voltage for the operation of the device, and the power supply unit 370 provides this voltage.

When viewed in FIG. 1, the communication unit 380 may be connected to the communication network 120 of FIG. 1 and may communicate with the apparatus 130 for recommending AI exercise. In other words, when there is an access point constituting the communication network 120, the communication unit 380 communicates with the access point to provide the sensing data provided by the posture sensor unit 340 to the apparatus 130 for recommending AI exercise of FIG. 1. In addition, when communicating with a base station such as an e-Node rather than the access point, the communication unit 380 may provide the sensing data to the apparatus 130 for recommending AI exercise of FIG. 1 via the base station.

In addition to the above contents, the clock unit (RTC) 300, the button unit 310, the output unit 320, the control unit 330, the posture sensor unit 340, the short-range sensor unit 350, the storage unit 360, the power supply unit 370, and the communication unit 380 of FIG. 3 may perform various operations, and other details have been sufficiently described through the posture measuring apparatus 100 of FIG. 1, so those contents will be used instead.

Figure 4:
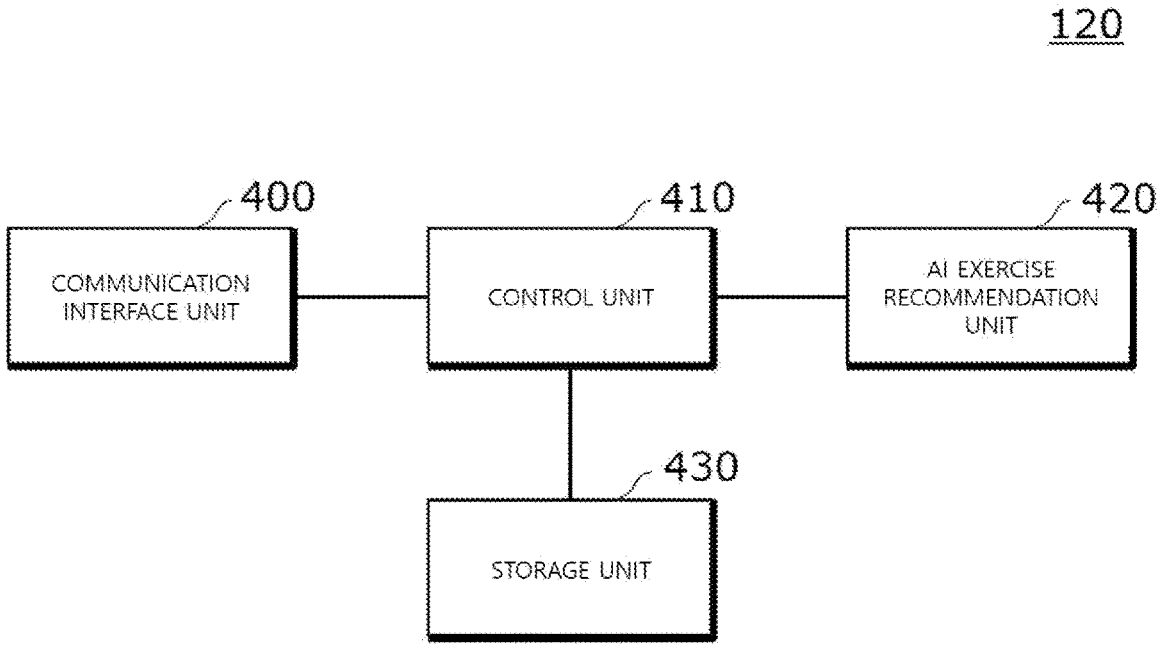
FIG. 4 is a block diagram illustrating a detailed structure of an apparatus for recommending AI exercise of FIG. 1.

FIG. 4 is a block diagram illustrating a detailed structure of an apparatus for recommending AI exercise of FIG. 1.

As illustrated in FIG. 4, the apparatus 130 for recommending AI exercise of FIG. 1 according to an embodiment of the present invention includes some or all of a communication interface unit 400, a control unit 410, an AI exercise recommendation unit 420, and a storage unit 430.

Here, "including some or all" means that the apparatus 130 for recommending AI exercise is configured by omitting some components, such as the storage unit 430, some components, such as the AI exercise recommendation unit 420, may be integrated with other components, such as the control unit 410, or the like, and the present invention will be described as including all components to facilitate a sufficient understanding of the present invention.

The communication interface unit 400 communicates with the posture measuring apparatus 100 and the user terminal apparatus 110, respectively, via the communication network 120 of FIG. 1. In the process of performing the communication, the communication interface unit 400 may perform operations such as modulation/demodulation, encoding/decoding, muxing/demuxing, and scaling to convert resolution. This is obvious to those skilled in the art, and therefore, further description will be omitted.

The communication interface unit 400 receives sensing data related to posture measurement for each user from the posture measuring apparatus 100 of FIG. 1. For example, the communication interface unit 400 may communicate with the apparatus 130 for recommending AI exercise when the power supply is turned on from the posture measuring apparatus 100. The posture measuring apparatus 100 may transmit the time information while transmitting the sensing data for measuring the user's posture, and may further transmit the device identification information of the posture measuring apparatus 100. Accordingly, the communication interface unit 400 may provide the sensing data, the time information, the device identification information, etc., transmitted from the posture measuring apparatus 100 to the control unit 410.

The communication interface unit 400 receives the sensing data provided from each posture measuring apparatus 100 owned by multiple users, respectively. Of course, when one user possesses the plurality of posture measuring apparatus 100 and performs the posture measurement movement using the posture measuring apparatus 100, the apparatus 130 for recommending AI exercise may determine a certain user through the device identification information provided by the posture measuring apparatus 100. Of course, this may be possible by registering the posture measuring apparatus 100 that the user possesses in advance when registering services by accessing the apparatus 130 for recommending AI exercise of FIG. 1, and in this process, by acquiring and storing the device identification information of the posture measuring apparatus 100, it is possible to determine which user possesses the posture measuring apparatus 100. Of course, when the service is initially provided, it is possible to allow the apparatus 130 for recommending AI exercise to identify the user's device by providing sensing data, etc., and inputting user information of a user in a pop-up window that pops up on the screen, and therefore, the embodiments of the present invention will not be particularly limited to any one form.

The control unit 410 is responsible for the overall control operation of the communication interface unit 400, the AI exercise recommendation unit 420, and the storage unit 430 of FIG. 4. The control unit 410 may be composed of a CPU or MPU and its peripheral circuits, and when device identification information, sensing data, and time information for a posture measuring apparatus 100 of a specific user are provided through the communication interface unit 400, the control unit may temporarily store the device identification information, the sensing data, and the time information in the storage unit 430, retrieve the temporarily stored device identification information, sensing data, and time information, and then provide the retrieved device identification information, sensing data, and time information to the AI exercise recommendation unit 420. In addition, the control unit 410 may be linked with the AI exercise recommendation unit 420 to perform various operations, and may recommend, for example, exercises for correcting a user's posture to the user terminal apparatus 110. Of course, these exercise recommendations are performed by the AI exercise recommendation unit 420, and the control unit 410 may control the communication interface unit 400 so that uniform resource locator (URL) information accessing video or video content of the recommended exercises are transmitted to the user terminal apparatus 110 of a person subject to posture correction in response to the request from the AI exercise recommendation unit 420.

The AI exercise recommendation unit 420 may process sensing data related to measurement of a user's posture provided from the posture measuring apparatus 100 into a specified format and systematically categorize and store the processed sensing data for each user in a database (DB) 130*a* of FIG. 1, and analyze big data of the sensing data accumulated and stored for each user to determine a posture of every user. For example, when basic posture data related to a person's spine is pre-stored and then sensing data for a specific user is provided, a spine tilt may be determined for each user by comparing the sensing data with the pre-stored basic posture data. In addition, the AI exercise recommendation unit 420 may recommend exercises for posture correction based on posture data of a body in forward and backward, left and right, and 360° directions. In an embodiment of the present invention, only when there is posture-related data in a 360° direction, it may be possible to recommend the exercises using the data.

In addition, the AI exercise recommendation unit 420 may recommend exercises in various ways when recommending the exercises. As described above, the AI exercise recommendation unit 420 recommends exercises based on the analysis results of the sensing data only to the posture measuring apparatuses 100 possessed by each user. Of course, when the corresponding user is using another posture measuring apparatus 100 that may also know a posture of a neck, a spine, or the like as illustrated in FIG. 2, it is possible to recommend exercises based on the analysis results by analyzing the sensing data including the same. For example, the tilt of the neck may be correlated with the tilt of the spine and may also be related to the user's sitting posture. Therefore, when recommending exercises, the AI exercise recommendation unit 420 may recommend exercises by referring to related parts together.

For example, the AI exercise recommendation unit 420 may recommend customized exercises for each user based on big data analysis through artificial intelligence deep learning programs, etc. In this case, when recommending exercises to specific users, the data learning is performed on the premise that a neck, a spine, a waist, etc., are correlated with each other, and when the analysis is performed accordingly and a specific user possesses only the posture measuring apparatus 100 related to the neck, it is possible to recommend neck exercises related to the spine and waist by referring to data from users in the same age group and same or similar occupation as the corresponding user. In other words, when the AI exercise recommendation unit 420 may recommend exercise A when simply considering only the neck, it is possible to increase the accuracy of exercise recommendations, such as recommending exercise B, by considering other parts through the artificial intelligence programs.

Furthermore, the AI exercise recommendation unit 420 may provide the analysis results of the posture measurement data to the service screen when the user terminal apparatus 110 requests services. The AI exercise recommendation unit 420 may provide analysis results of the time to maintain correct posture, posture-related data analysis results for each cycle, a posture score, and further analysis results of a 360° posture zone to a UI screen. For example, the UI screen may be divided into three areas to provide the analysis results so that users may check posture-related analysis results by date, that is, check the posture-related analysis results at a glance through one screen. The first zone at the top may display a calendar. In the second zone, which is below the first zone, the daily goal and posture score may be displayed on the left and right, respectively. Of course, the daily goal and posture score of the second zone may be provided in the form of a diagram such as a graph. Furthermore, the analysis results related to the 360° posture zone may be provided in the third zone located at the bottom of the second zone. The chart provided in the third zone is configured in the form of a target, that is, processed graphically and divided into 8 sections: forward and backward F and B, left and right L and R, and middle areas FR, BR, BL, and FL. By displaying specific sections in color, users may immediately check their tilted postures. For example, by displaying the section corresponding to the front F in red, it is possible to see that the user's posture is tilted forward a lot.

It has been described in advance through FIG. 3 that the posture measuring apparatus 100 may recognize peripheral devices through the short-range sensor unit 350. Therefore, when a device such as a nearby TV or computer is detected, the type of device may be known through the device identification information, and the AI exercise recommendation unit 420 may recognize the peripheral device to determine whether a user is working in a specific occupation, such as an office worker, or watching TV. Of course, the AI exercise recommendation unit 420 may be able to use the direction of the device as standards to determine the standards such as forward and backward, left and right, etc., from the user's posture. For example, when watching TV, the direction in which the TV is detected is a forward direction of the user, and through this, the tilt may be displayed in color in the posture zone. The AI exercise recommendation unit 420 may further refer to the recognition results of the peripheral devices, recommend customized exercises for each user based on the recognition results, and provide various services in this regard. For example, when a user is watching TV and there is an artificial intelligence speaker nearby, the speaker may output voice such as "Shoulders are bent too much and there is a need to stretch deltoids!" Of course, it is also possible to transmit the voice to the user terminal apparatus 110 possessed by the user, so embodiments of the present invention will not be particularly limited to any one form.

The storage unit 430 processes various types of data processed under the control of the control unit 410. The storage unit 430 may temporarily store the device identification information, the time information, and the sensing data for sensing the user's posture provided by the posture measuring apparatus 100, and then provide the stored device identification information, time information, and sensing data to the AI exercise recommendation unit 420 under the control of the control unit 410 for data analysis.

In addition to the above contents, the communication interface unit 400, the control unit 410, the AI exercise recommendation unit 420, and the storage unit 430 of FIG. 4 may perform various operations, and other details have been sufficiently described in advance, so it will be replaced by those contents.

The communication interface unit 400, the control unit 410, the AI exercise recommendation unit 420, and the storage unit 430, and the like of FIG. 4 according to the embodiment of the present invention are configured in a hardware module physically separated from each other, but each module may store software for performing the above operation therein and may execute the software. However, since the software is a set of software modules, and each module can be formed of hardware, but will not be particularly limited to the configuration of software or hardware. For example, the storage unit 430 may be a hardware storage or a memory. However, since it is possible to perform repository of information in the form of software, it will not be particularly limited to the above.

Meanwhile, as another embodiment of the present invention, the control unit 410 may include a CPU and a memory, and may be formed as a single chip. The CPU includes a control circuit, an arithmetic unit (ALU), an instruction interpretation unit, a registry, and the like, and the memory may include a random access memory (RAM). The control circuit may perform a control operation, the arithmetic unit may perform an arithmetic operation of binary bit information, the instruction interpretation unit includes an interpreter, compiler or the like and may perform an operation of converting a high-level language into a machine language and a machine language into a high-level language, and the registry may be involved in software data storage. According to the above configuration, for example, at the beginning of the operation of the apparatus 130 for recommending AI exercise, the programs stored in the AI exercise recommendation unit 420 are copied and loaded into memory, that is, a RAM, and then executed, so the data operation processing speed may be rapidly increased. The deep learning model may be loaded into a graphic processing unit (GPU) memory rather than the RAM and executed by accelerating the execution speed using the GPU.

Figure 5:
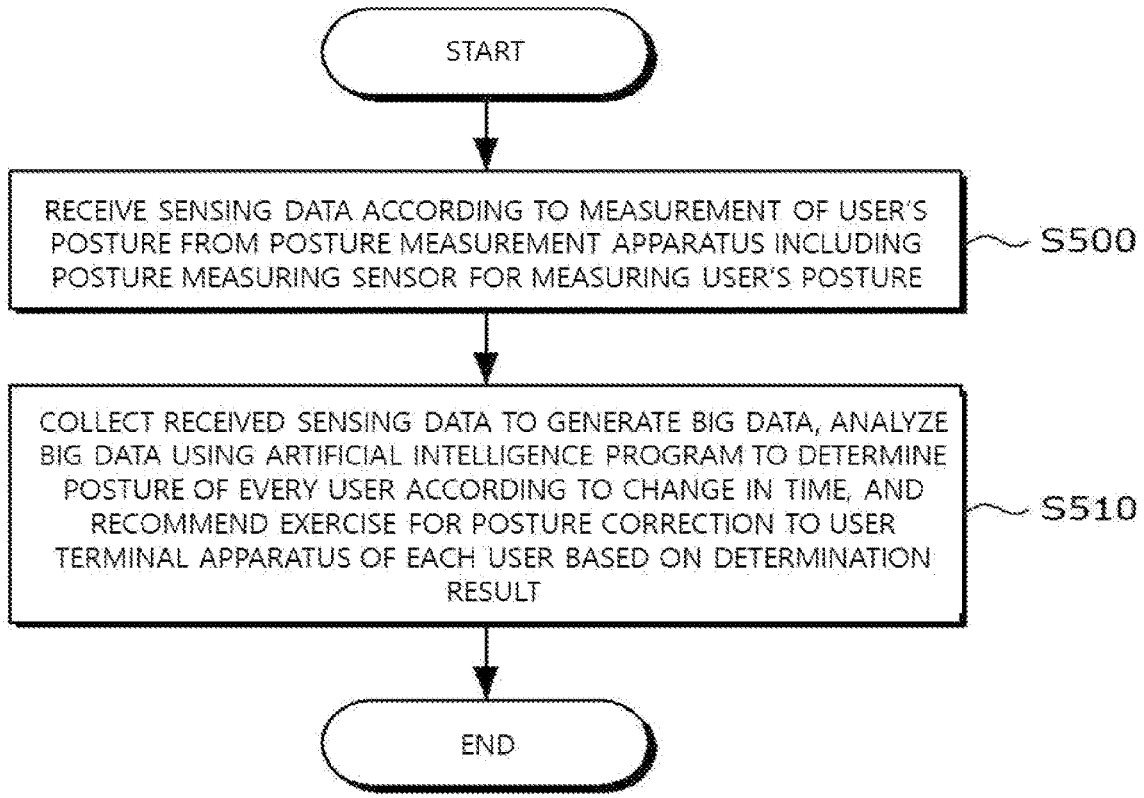
FIG. 5 is a flowchart illustrating a driving process of the apparatus for recommending AI exercise of FIG. 1.

FIG. 5 is a flowchart illustrating a driving process of the apparatus for recommending AI exercise of FIG. 1.

Referring to FIG. 5 together with FIG. 1 for convenience of description, the apparatus 130 for recommending AI exercise according to an embodiment of the present invention receives the sensing data according to the measurement of the user's posture from the posture measuring apparatus 100 including the posture measurement sensor for measuring the user's posture (S500). Here, the posture measuring apparatus 100 preferably receives three-dimensional sensing data to recommend posture correction-related exercises to each user. Of course, it is possible to receive sensing data related to pressure at a specific location through a pressure sensor like a smart seat, but in the embodiment of the present invention, it is preferable to receive sensing data that may know the body's tilt in the forward and backward, left and right, 360° directions through the belt-type wearable device worn on the center of the user's chest.

In addition, the apparatus 130 for recommending AI exercise collects the received sensing data to form the big data, analyzes the big data using the artificial intelligence program to determine a posture of every user according to the change in time, and recommends the exercises for the posture correction to the user terminal apparatuses 110 of each user based on the determination results (S510). Of course, in addition to this, the apparatus 130 for recommending AI exercise may provide the analysis results of sensing data to the user terminal apparatus 110 in the form of the UI screen, and the analysis results of the 360° posture zone, which are the analysis results of the sensing data related to the 360° degree direction, may be provided on the corresponding UI screen in the form of the visualization image. Here, the visualization image is divided into a total of 8 sections, including forward and backward, left and right, and the sections therebetween in the form of the target, and thus, may be in the form of displaying color in each section.

In addition to the above contents, the apparatus 130 for recommended AI exercise of FIG. 1 may perform various operations, and other details have been sufficiently described in advance, so it will be replaced by those contents.

Meanwhile, although the case in which all the components configuring an exemplary embodiment of the present invention are combined with each other as one component or are combined and operated with each other has been described, the present invention is not necessarily limited thereto. That is, all the components may also be selectively combined and operated with each other as one or more components without departing from the scope of the present disclosure. In addition, although each of all the components may be implemented by one independent hardware, some or all of the respective components which are selectively combined with each other may be implemented by a computer program having a program module performing some or all of the functions combined with each other in one or plural hardware. Codes and code segments configuring the computer program may be easily inferred by those skilled in the art to which the present disclosure pertains. The computer program is stored in non-transitory computer readable media and is read and executed by a computer, thereby making it possible to implement an exemplary embodiment of the present invention.

Here, the non-transitory computer readable medium is not a medium that stores data therein for a while, such as a register, a cache, a memory, or the like, but means a medium that semi-permanently stores data therein and is readable by a device. In detail, the programs described above may be stored and provided in the non-transitory computer readable medium such as a CD, a digital versatile disk (DVD), a hard disk, a Blu-ray disk, a USB, a memory card, a ROM, or the like.

Although exemplary embodiments of the present invention have been illustrated and described, the present invention is not limited to the above-mentioned specific exemplary embodiment, but may be variously modified by those skilled in the art to which the present invention pertains without departing from the spirit and scope of the present invention as claimed in the claims. In addition, such modifications should also be understood to fall within the scope of the present invention.

According to the present invention, by collecting and analyzing daily data where users sit, stand, and move based on the posture measurement sensor, it is possible to prescribe customized exercises to the users based on the AI data analysis.

In addition, according to the present invention, it is possible to provide a posture correction subscription service for 1:1 customized posture coaching based on the AI.

In addition, according to the present invention, it is possible to enable users to perform self-directed health management even in a non-face-to-face manner in order to prevent spinal diseases and the like.

The effects according to the present invention are not limited to the contents exemplified above, and further various effects are included in the present specification.

In the above, the present invention has been described with reference to specific matters such as specific components and limited embodiments and drawings, but these are only provided to help a more general understanding of the present invention, and the present invention is not limited to the above embodiments, and those of ordinary skill in the art to which the invention pertains can make various modifications and changes from these descriptions.

Therefore, the spirit of the present invention should not be limited to these exemplary embodiments, but the claims and all of modifications equal or equivalent to the claims are intended to fall within the scope and spirit of the present invention.

What is claimed is:

1. An apparatus for recommending artificial intelligence (AI) exercise by analyzing data collected by a posture measurement sensor, the apparatus comprising:

a communication interface unit that receives sensing data according to measurement of a user's posture from a posture measuring apparatus including a posture measurement sensor for measuring the user's posture; and a control unit that collects the received sensing data to form big data, analyzes the big data using an AI program to determine postures of each user according to a change in time, and recommends exercise for posture correction to user terminal apparatuses of each user based on a determination result, wherein the posture measuring apparatus includes:

a clock unit that corresponds to a real-time clock (RTC) (unit);

a button unit that adjusts a sound volume of a speaker or vibration intensity of a vibration motor;

an output unit that includes a light-emitting element including a light emitting diode (LED) element for displaying a state in which the posture measuring apparatus is currently operating, a speaker that outputs posture-related contents to the user as a voice, and an oscillator indicating whether the posture is corrected based on vibrations;

a posture sensor unit that includes an acceleration sensor and a gyro sensor and detects a 360° movement direction of the user;

a short-range sensor unit that detects a surveillance object located in a direction in which the user gazes;

a communication unit that communicates with an access point when there is an access point constituting a communication network and provides sensing data provided by the posture sensor unit to the apparatus for recommending AI exercise;

a power supply unit that applies power to the clock unit, the button unit, the output unit, the posture sensor unit, the short-range sensor unit, and the communication unit; and a control unit that operates by receiving the power from the power supply unit, and controls the clock unit, the button unit, the output unit, the posture sensor unit, the short-range sensor unit, the communication unit, and the power supply unit, the apparatus for recommending AI exercise collects the sensing data from the posture measuring apparatus to form the big data, analyzes the formed big data and determines postures of each user according to the change in time to predict a future posture, and provides, to a user terminal apparatus of the user, related video while recommending exercise for posture correction based on the prediction result, the apparatus for recommending AI exercise displays a calendar in a first zone at a top of a screen to provide a user interface (UI) screen related to a posture score, a daily goal, and a 360° posture zone to the user terminal apparatus, displays the daily goal in a form of a diagram corresponding to a chart, a graph, or a statistical chart on a left side of a second zone located at a bottom of the first zone, displays the posture score to a right of the second zone, displays a 360° posture zone chart in a third zone located at a bottom of the second zone on the same UI screen, and displays a front portion in red when the user's posture is tilted forward, an appearance of the user from above is displayed in a center of the posture zone chart, which is processed in a form of a target, the posture zone chart in the form of the target is displayed in various colors while being divided into eight sections of F, FR, R, BR, B, BL, L, and FL, the posture measuring apparatus detects a nearby TV through the short-range sensor unit, recognizes the TV when the TV is detected and determines whether the user is watching the TV to recommend customized exercises for each user, displays a tilt in color on the posture zone chart as a direction in which the TV is detected is a forward direction of the user while the user is watching the TV, and outputs a voice message recommending the exercise through a peripheral speaker, the posture measuring apparatus corresponds to at least one of i) a first posture measuring apparatus of a belt type that includes a 3-axis acceleration sensor and a 3-axis gyro sensor for measuring movement of a body in forward and backward, left and right, and 360° directions and is worn like a belt on a central portion of a chest, ii) a second posture measuring apparatus of a sports bra type that measures a spine tilt while collecting sensing data for a spine when the user bends over and stands upright, iii) a third posture measuring apparatus of a smart seat type that includes a pressure sensor and determines which side is most pressured based on the sensing data of the pressure sensor to analyze the user's sitting posture, and iv) a fourth posture measuring apparatus of a turtleneck habit corrector type that is worn on the user's head or neck and detects movement of the neck through the 3-axis acceleration and 3-axis gyro sensor to generate the sensing data, and the apparatus for recommending AI exercise analyzes based on the sensing data acquired from each of the first posture measuring apparatus, the second posture measuring apparatus, the third posture measuring apparatus, and the fourth posture measuring apparatus, recommends posture correction exercise to a specific user who possesses a specific posture measuring apparatus based on an analysis result, and uses data on a similar user whose sex, age, physical condition, and occupational group correspond to the specific user while recommending the posture correction exercise.

2. The apparatus of claim 1, wherein the control unit analyzes the sensing data provided by measuring the user's posture in the forward and backward, left and right, and 360° directions by the posture measuring apparatus worn on a central portion of the user's chest, and recommends the exercise based on the analysis result.

3. The apparatus of claim 2, wherein, when requesting service from the user terminal apparatus, the control unit provides a visualization screen related to a tilt of the user's body in the 360° direction.

4. The apparatus of claim 2, wherein the control unit compares and analyzes reference posture data preset based on a human spine with the sensing data for each user, detects spine tilts for each user, and determines the postures of each user based on the detection result.

5. The apparatus of claim 1, wherein the control unit receives and processes sensing data on spine movement forward and backward, left and right, and 360° for each user generated by a posture sensor as the posture measurement sensor.

6. A method of driving an apparatus for recommending artificial intelligence (AI) exercise by analyzing data collected by a posture measurement sensor, the method comprising:

receiving, by a communication interface unit, sensing data according to measurement of a user's posture from a posture measuring apparatus including a posture measurement sensor for measuring the user's posture; and forming big data by allowing a control unit to collect the received sensing data, determining postures of each user according to a change in time by analyzing the big data using an AI program, and recommending exercise for posture correction to user terminal apparatuses of each user based on a determination result, wherein the posture measuring apparatus includes:

a clock unit that corresponds to a real-time clock (RTC) (unit);

a button unit that adjusts a sound volume of a speaker or vibration intensity of a vibration motor;

an output unit that includes a light-emitting element including a light emitting diode (LED) element for displaying a state in which the posture measuring apparatus is currently operating, a speaker that outputs posture-related contents to the user as a voice, and an oscillator indicating whether the posture is corrected based on vibrations;

a posture sensor unit that includes an acceleration sensor and a gyro sensor and detects a 360° movement direction of the user;

a short-range sensor unit that detects a surveillance object located in a direction in which the user gazes;

a communication unit that communicates with an access point when there is an access point constituting a communication network and provides sensing data provided by the posture sensor unit to the apparatus for recommending AI exercise;

a power supply unit that applies power to the clock unit, the button unit, the output unit, the posture sensor unit, the short-range sensor unit, and the communication unit; and a control unit that operates by receiving the power from the power supply unit, and controls the clock unit, the button unit, the output unit, the posture sensor unit, the short-range sensor unit, the communication unit, and the power supply unit, the control unit of the apparatus for recommending AI exercise collects the sensing data from the posture measuring apparatus to form the big data, analyzes the formed big data and determines postures of each user according to the change in time to predict a future posture, and provides, to a user terminal apparatus of the user, related video while recommending exercise for posture correction based on the prediction result, the control unit of the apparatus for recommending AI exercise displays a calendar in a first zone at a top of a screen to provide a user interface (UI) screen related to a posture score, a daily goal, and a 360° posture zone to the user terminal apparatus, displays the daily goal in a form of a diagram corresponding to a chart, a graph, or a statistical chart on a left side of a second zone located at a bottom of the first zone, displays the posture score to a right of the second zone, displays a 360° posture zone chart in a third zone located at a bottom of the second zone on the same UI screen, and displays a front portion in red when the user's posture is tilted forward, an appearance of the user from above is displayed in a center of the posture zone chart which is processed in a form of a target, the posture zone chart in the form of the target is displayed in various colors while being divided into eight sections of F, FR, R, BR, B, BL, L, and FL, the posture measuring apparatus detects a nearby TV through the short-range sensor unit, recognizes the TV when the TV is detected and determines whether the user is watching the TV to recommend customized exercises for each user, displays a tilt in color on the posture zone chart as a direction in which the TV is detected is a forward direction of the user while the user is watching the TV, and outputs a voice message recommending the exercise through a peripheral speaker, the posture measuring apparatus corresponds to at least one of i) a first posture measuring apparatus of a belt type that includes a 3-axis acceleration sensor and a 3-axis gyro sensor for measuring movement of a body in forward and backward, left and right, and 360° directions and is worn like a belt on a central portion of a chest, ii) a second posture measuring apparatus of a sports bra type that measures a spine tilt while collecting sensing data for a spine when the user bends over and stands upright, iii) a third posture measuring apparatus of a smart seat type that includes a pressure sensor and determines which side is most pressured based on the sensing data of the pressure sensor to analyze the user's sitting posture, and iv) a fourth posture measuring apparatus of a turtleneck habit corrector type that is worn on the user's head or neck and detects movement of the neck through the 3-axis acceleration and 3-axis gyro sensor to generate the sensing data, and the control unit of the apparatus for recommending AI exercise analyzes based on the sensing data acquired from each of the first posture measuring apparatus, the second posture measuring apparatus, the third posture measuring apparatus, and the fourth posture measuring apparatus, recommends posture correction exercise to a specific user who possesses a specific posture measuring apparatus based on an analysis result, and uses data on a similar user whose sex, age, physical condition, and occupational group correspond to the specific user while recommending the posture correction exercise.

7. The method of claim 6, wherein, in the recommending of the exercise for posture correction, the sensing data provided by measuring the user's posture in the forward and backward, left and right, and 360° directions by the posture measuring apparatus worn on a central portion of the user's chest is analyzed, and the exercise is recommended based on the analysis result.

8. The method of claim 7, wherein, in the recommending of the exercise for posture correction, when requesting service from the user terminal apparatus, a visualization screen related to a tilt of the user's body in the 360° direction is provided.

9. The method of claim 7, wherein, in the recommending of the exercise for posture correction, reference posture data preset based on a human spine is compared and analyzed with the sensing data for each user, spine tilts for each user are detected, and the postures of each user are determined based on a detection result.

10. The method of claim 6, wherein, in the recommending of the exercise for posture correction, sensing data for forward and backward, left and right, and 360° spine movements for each user generated by a posture sensor as the posture measurement sensor are received and processed.

* * * * *